US006880179B2

(12) United States Patent
Wang

(10) Patent No.: US 6,880,179 B2
(45) Date of Patent: Apr. 19, 2005

(54) SINK STOPPER

(75) Inventor: Yu-Jen Wang, Tainan Hsien (TW)

(73) Assignee: Fu Luong Hi-Tech Co., Ltd., Shan Hua (TW)

( * ) Notice: Subject to any disclaimer, the term of this patent is extended or adjusted under 35 U.S.C. 154(b) by 108 days.

(21) Appl. No.: 10/436,338

(22) Filed: May 12, 2003

(65) Prior Publication Data

US 2004/0226085 A1 Nov. 18, 2004

(51) Int. Cl.[7] ..... A47K 1/14
(52) U.S. Cl. ..... 4/295; 4/286
(58) Field of Search ..... 4/286–295, 688, 4/699, 693

(56) References Cited

U.S. PATENT DOCUMENTS 4,369,531 A * 1/1983 Swanson ..... 4/295
6,219,861 B1 * 4/2001 Chen ..... 4/295
6,442,770 B1 * 9/2002 Lin ..... 4/295
6,490,739 B1 * 12/2002 Lee ..... 4/293

FOREIGN PATENT DOCUMENTS

GB 22233894 A * 1/1991

* cited by examiner

*Primary Examiner*—Gregory Huson
*Assistant Examiner*—Khoa Huynh
(74) *Attorney, Agent, or Firm*—Frommer Lawrence & Haug LLP; Ronald R. Santucci

(57) ABSTRACT

A sink stopper is provided for a sink body having a base formed with a drain hole, and includes a strainer, an operating device and a closure member. The strainer is mounted on the base, and has a perforated strainer wall disposed in the drain hole. The operating device includes a stationary member mounted on the strainer wall, a movable member coupled movably to the stationary member, and a switching unit operable to retain releasably the movable member between first and second positions relative to the stationary member. The closure member is mounted on the movable member, is configured to form a clearance with the base to permit draining of water through the drain hole when the movable member is at the first position, and abuts sealingly against the base to seal the drain hole when the movable member is at the second position.

8 Claims, 5 Drawing Sheets

SINK STOPPER

BACKGROUND OF THE INVENTION

1. Field of the Invention

The present invention relates to a sink stopper, more particularly to a sink stopper adapted to be mounted fixedly in a drain hole of a sink.

2. Description of the Related Art

Conventional sink stoppers are shaped as plugs or discs. When water is to be retained in a sink, a sink stopper is used to seal a drain hole of the sink. On the other hand, when water is to be drained from the sink, the sink stopper is removed from the drain hole. However, in practice, when the sink stopper is removed from the drain hole, it is simply placed on one side of the sink, which can result in accidental dropping and misplacing of the sink stopper due to the lack of a connection with the sink.

SUMMARY OF THE INVENTION

Therefore, the object of the present invention is to provide a sink stopper that can overcome the aforesaid drawback associated with prior art.

Accordingly, the sink stopper of the present invention is adapted for use with a sink body having a base formed with a drain hole that is confined by a tubular hole-confining wall. The sink stopper comprises a strainer, an operating device, and a closure member.

The strainer is adapted to be mounted on the base, and has a perforated strainer wall to be disposed in the drain hole.

The operating device includes stationary and movable members, and a switching unit. The stationary member extends along an axis and is formed with a first mounting end that is mounted on the perforated strainer wall of the strainer. The movable member is coupled movably to the stationary member, and is formed with a second mounting end. The movable member is movable along the axis relative to the stationary member to move the second mounting end toward and away from the first mounting end. The switching unit is provided on the stationary and movable members, and is operable to retain releasably the movable member at a selected one of first and second positions relative to the stationary member. The second mounting end forms a first distance with the first mounting end when the movable member is at the first position. The second mounting end forms a second distance with the first mounting end, the second distance being shorter than the first distance, when the movable member is at the second position.

The closure member is mounted on the second mounting end of the movable member, is configured to form a clearance with the base to permit draining of water in the sink body through the drain hole when the movable member is at the first position, and is adapted to abut sealingly against the base to seal the drain hole when the movable member is at the second position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
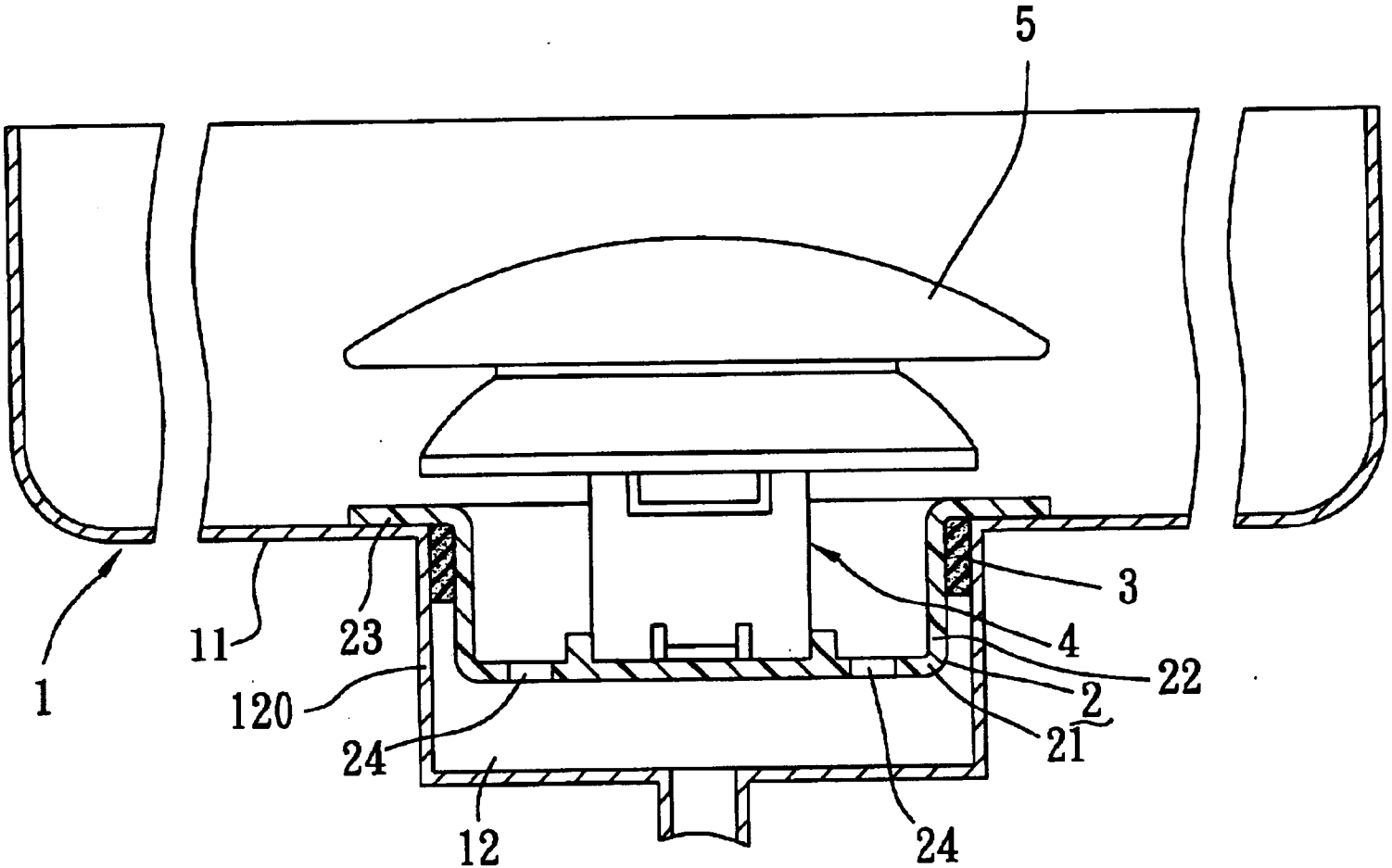
FIG. 1 is a schematic partly sectional view illustrating the preferred embodiment of a sink stopper according to the present invention when mounted on a sink.
Figure 2:
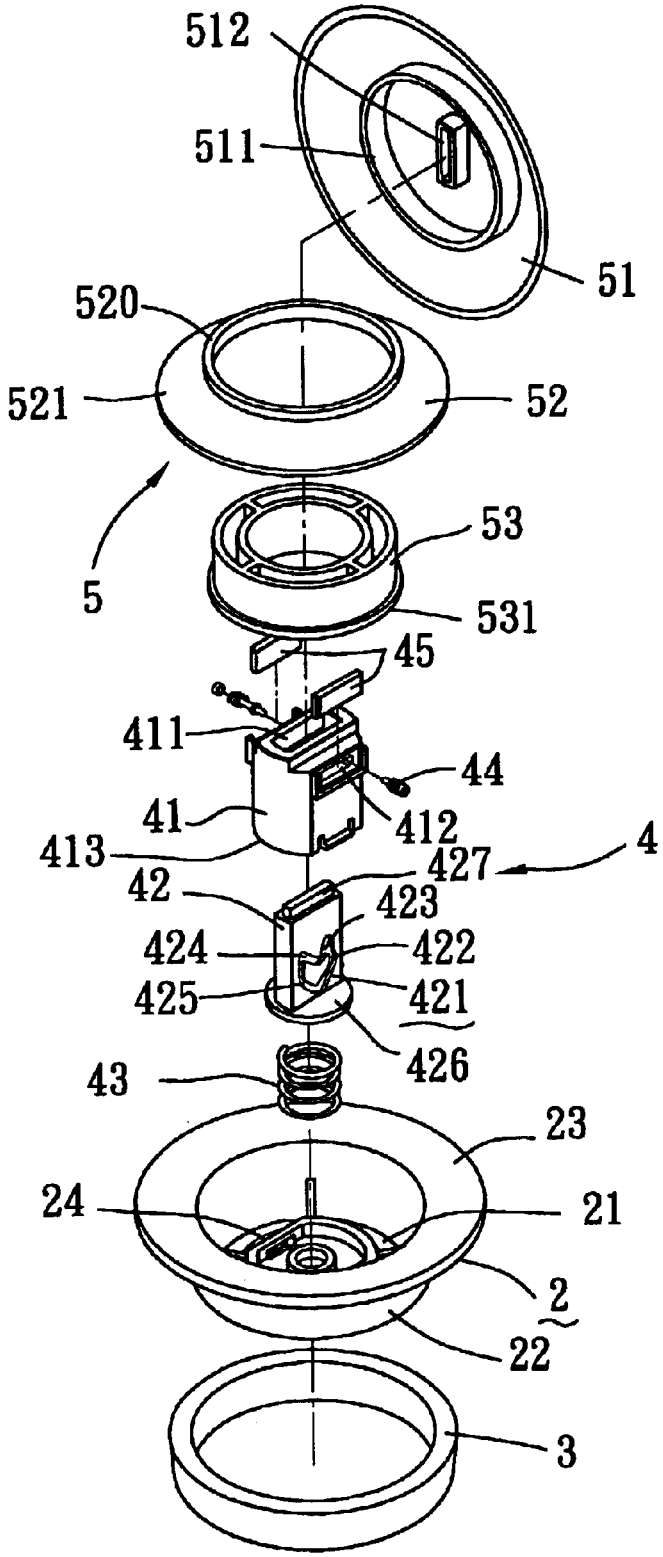
FIG. 2 is an exploded perspective view of the preferred embodiment.

Referring to FIGS. 1 and 2, the preferred embodiment of a sink stopper according to the present invention is shown to be mounted on a sink body 1 having a base 11 formed with a drain hole 12 that is confined by a tubular hole-confining wall 120 and that defines an axis. The sink stopper includes a strainer 2, a rubber gasket 3, an operating device 4, and a closure member 5.

The strainer 2 is adapted to be mounted on the base 11 of the sink body 1, and has a perforated strainer wall 21 to be disposed in the drain hole 12. The strainer wall 21 is formed with a plurality of strainer holes 24 and has an outer peripheral edge. The strainer 2 further has a peripheral wall 22 that extends from the outer peripheral edge of the strainer wall 21 around the axis and that has a distal edge, and a peripheral flange 23 that extends radially and outwardly from the distal edge of the peripheral wall 22. When the strainer 2is mounted on the base 11, the peripheral wall 22 extends into the drain hole 12 to dispose the strainer wall 21 in the drain hole 12, and the peripheral flange 23 is seated on the base 11 of the sink body 1. The rubber gasket 3 is sleeved on the peripheral wall 22 of the strainer 2 and is adapted to abut sealingly against the 20 hole-confining wall 120 to block seepage of water into the drain hole 12 from between the peripheral flange 23 and the base 11 when the strainer 2 is mounted on the base 11 of the sink body 1.

Figure 3:
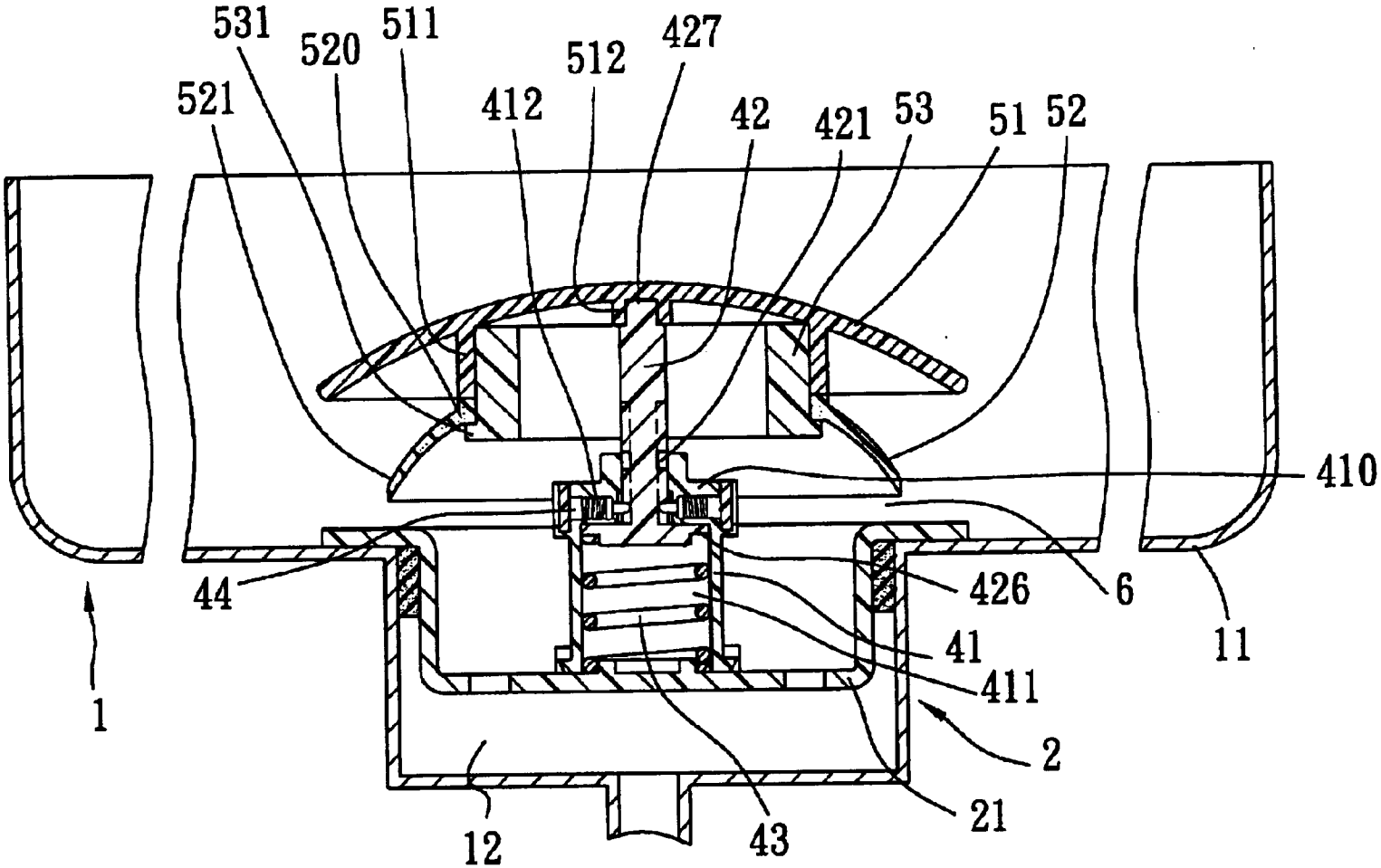
FIG. 3 is a schematic sectional view of the preferred embodiment, illustrating the sink stopper when in a water-draining state.

With further reference to FIG. 3, the operating 25 device 4 includes a stationary member 41, a movable member 42, and a switching unit.

The stationary member 41 includes a tubular sleeve extending along the axis and formed with a first mounting end 413 that is mounted on the strainer wall 21 of the strainer 2. The sleeve confines a receiving space 411 for receiving the movable member 42, and further has a tumbler mounting flange 410 that extends inwardly from one end of the sleeve opposite to the first mounting end 413. The tumbler mounting flange 410 is formed with a pair of opposite tumbler holes 412 that extend transverse to the axis and that respectively have an inner hole end adjacent to the movable member 42, and an outer hole end opposite to the inner hole end. Each tumbler hole 412 has a length on a plane transverse to the axis. The stationary member 41 further has a pair of tumbler caps 45, each of which closes the outer hole end of the respective tumbler hole 412.

The movable member 42 extends slidably into the stationary member 41, and is formed with a second mounting end 427. The movable member 42 is movable along the axis relative to the stationary member 41 to move the second mounting end 427 toward and away from the first mounting end 413. The movable member 42 further has a stop flange 426 that extends from one end of the movable member 42 opposite to the second mounting end 427. The stop flange 426 is disposed in the receiving space 411, and abuts against the tumbler mounting flange 410 to prevent removal of the movable member 42 from the stationary member 41.

Figure 4:
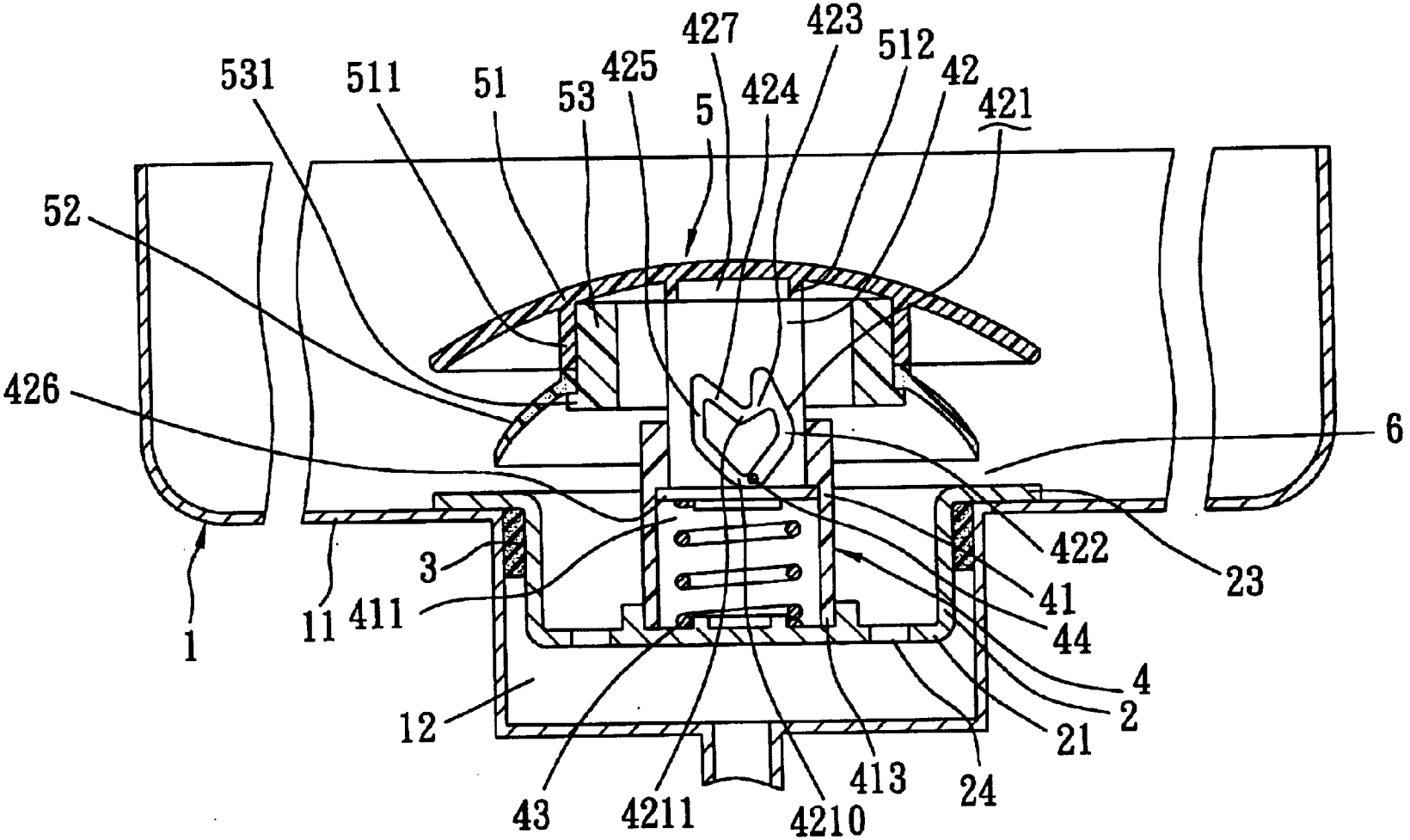
FIG. 4 is a schematic sectional view of the preferred embodiment when viewed from another angle while in the water-draining state.
Figure 5:
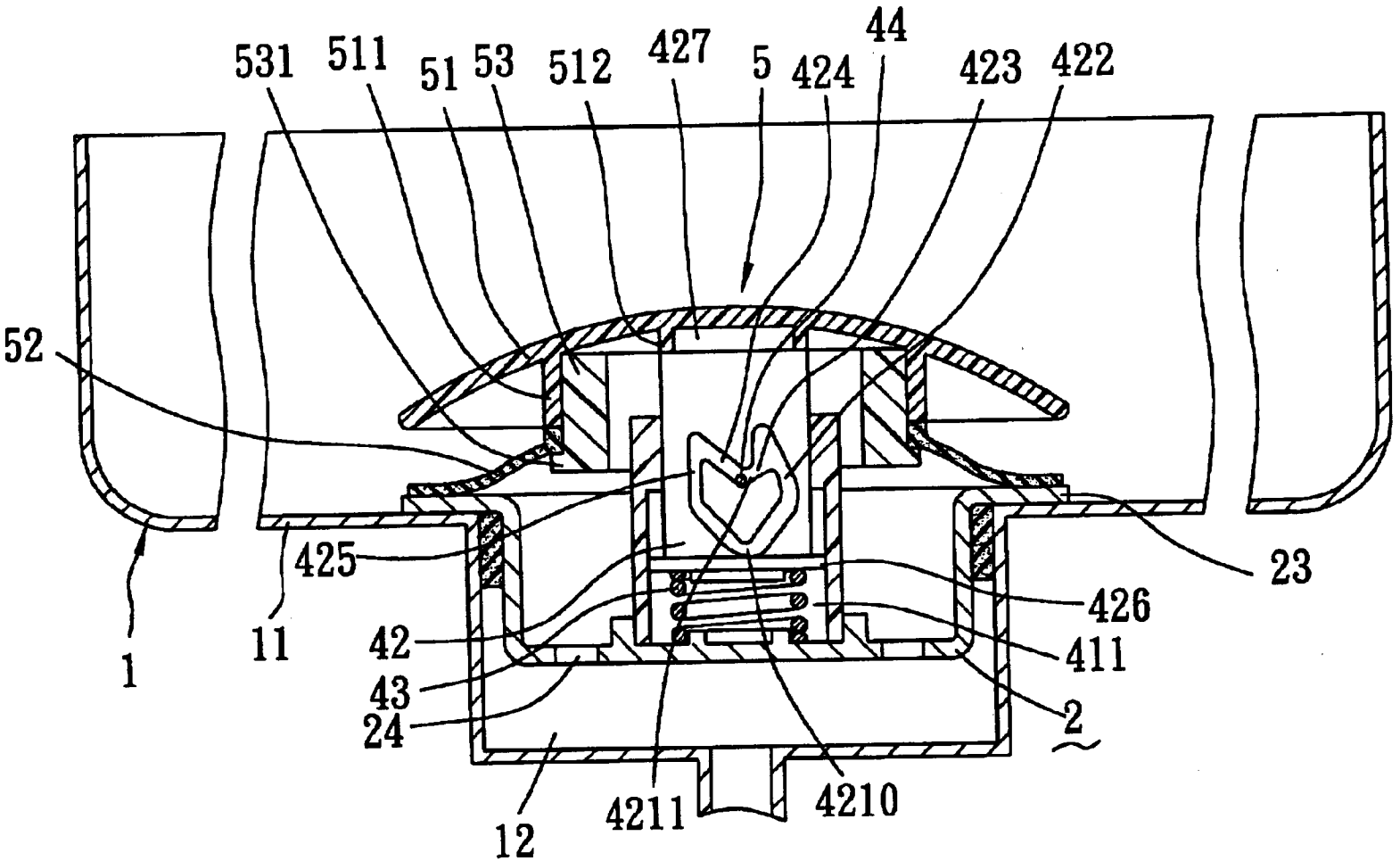
FIG. 5 is a schematic sectional view of the preferred embodiment, illustrating the sink stopper when in a water-retaining state.

In this embodiment, the switching unit includes a pair of looped guide grooves 421 formed in opposite sides of the movable member 42, a pair of spring-loaded tumblers 44 mounted respectively in the tumbler holes 412 and projecting through the inner hole ends of the tumbler holes 412 to engage respectively the guide grooves 421, and a biasing member 43 disposed in the receiving space 411 and biasing the stop flange 426 toward the tumbler mounting flange 410. The tumblers 44 are movable along the lengths of the tumbler holes 412. Accordingly, the movable member 42 is biased by the biasing member 43 along the axis to extend outwardly of the stationary member 41. As shown in FIGS. 4 and 5, each guide groove 421 has first and second control points 4210, 4211 spaced apart from each other along the axis. The tumblers 44 engage the respective guide groove 421 at one of the first and second control points 4210, 4211 to retain releasably the movable member 42 at a corresponding one of first and second positions relative to the stationary member 41. As shown in FIG. 4, the second mounting end 427 of the movable member 42 forms a first distance with the first mounting end 413 of the stationary member 41 when the movable member 42 is at the first position. As shown in FIG. 5, the second mounting end 427 forms a second distance with the first mounting end 413, the second distance being shorter than the first distance, when the movable member 42 is at the second position.

In this embodiment, as the axis extends in a vertical direction, the first control point 4210 is disposed below the second control point 4211. Each guide groove 421 further has a first section 422 ascending from the first control point 4210 and having an upper end disposed at a level above the second control point 4211, a second section 423 descending from the upper end of the first section 422 and extending to the second control point 4211, a third section 424 ascending from the second control point 4211 and having an upper end disposed at a level above the second control point 4211, and fourth section 425 descending from the upper end of the third section 424 and extending to the first control point 4210.

Referring to FIGS. 2 and 4, the closure member 5 includes a press cap 51 mounted on the second mounting end 427 of the movable member 42, and a seal ring 52 having an inner peripheral portion 520 that is connected to the press cap 51 and a skirt portion 521 that extends in radial outward directions from the inner peripheral portion 520. The skirt portion 521 is configured to form a clearance 6 with the base 11 to permit draining of water in the sink body 1 through the drain hole 12 when the movable member 42 is at the first position (see FIGS. 3 and 4), and is adapted to abut sealingly against the base 11 to seal the drain hole 12 when the movable member 42 is at the second position (see FIG. 5). In this embodiment, the press cap 51 has a bottom side formed with a mounting sleeve 512 for engaging the second mounting end 427 of the movable member 42, and a coupling sleeve 511 surrounding the mounting sleeve 512 and having a distal end. The closure member 5 further includes a fixing ring 53 fitted into the coupling sleeve 511 and having a distal end formed with a radial outward end flange 531. The inner peripheral portion 520 of the seal ring 52 is clamped between the distal end of the coupling sleeve 511 and the end flange 531 on the fixing ring 53.

In practice, referring to FIG. 4, while the tumblers 44 engage the respective guide groove 421 at the first control point 4210, application of a first pressing force on the closure member 5 against biasing action of the biasing member 43 retracts the movable member 42 into the stationary member 41 and causes the tumblers 44 to move along the first sections 422 of the guide grooves 421 until the tumblers 44 are disposed at the upper end of the first sections 422. Subsequent removal of the first pressing force enables the movable member 42 to extend out of the stationary member 41 by virtue of the biasing action of the biasing member 43 and causes the tumblers 44 to move along the second sections 423 until the tumblers 44 engage the respective guide groove 421 at the second control point 4211, thereby retaining the movable member 42 at the second position, as best shown in FIG. 5.

Referring to FIG. 5, while the tumblers 44 engage the respective guide groove 421 at the second control point 4211, application of a second pressing force on the closure member 5 against the biasing action of the biasing member 43 retracts the movable member 42 into the stationary member 41 and causes the tumblers 44 to move along the third sections 424 until the tumblers 44 are disposed at the upper end of the third sections 424. Subsequent removal of the second pressing force enables the movable member 42 to extend out of the stationary member 41 by virtue of the biasing action of the biasing member 43 and causes the tumblers 44 to move along the fourth sections 425 until the tumblers 44 engage the respective guide groove 421 at the first control point 4210, thereby retaining the movable member 42 at the first position, as best shown in FIG. 4.

In sum, by simple pressing actions on the closure member 5 to drive the operating device 4, the sink stopper of this invention can seal or open the drain hole 12 for water-retaining or water-draining without the need to remove the sink stopper from the drain hole 12.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A sink stopper for a sink body having a base formed with a drain hole that is confined by a tubular hole-confining wall, said sink stopper comprising:

a strainer adapted to be mounted on the base and having a perforated strainer wall to be disposed in the drain hole;

an operating device including a stationary member extending along an axis and formed with a first mounting end that is mounted on said perforated strainer wall of said strainer, a movable member coupled movably to said stationary member and formed with a second mounting end, said movable member being movable along said axis relative to said stationary member to move said second mounting end toward and away from said first mounting end, and a switching unit provided on said stationary and movable members and operable to retain releasably said movable member at a selected one of first and second positions relative to said stationary member, wherein said second mounting end forms a first distance with said first mounting end when said movable member is at the first position, and wherein said second mounting end forms a second distance with said first mounting end, said second distance being shorter than said first distance, when said movable member is at the second position; and a closure member mounted on said second mounting end of said movable member, said closure member being configured to form a clearance with the base to permit draining of water in the sink body through the drain hole when said movable member is at the first position, and being adapted to abut sealingly against the base to seal the drain hole when said movable member is at the second position;

wherein said stationary member includes a tubular sleeve, and said movable member extends slidably into said stationary member, wherein said switching unit includes looped guide groove formed in said movable member, spring-loaded tumbler mounted on said stationary member and engaging said guide groove, said guide groove having first and second control points spaced apart from each other along said axis, said tumbler engaging said guide groove at one of said first and second control points to retain releasably said movable member at a corresponding one of the first second positions, wherein said switching unit further includes a biasing member for biasing said movable member along said axis extend outwardly of said stationary member, wherein said stationary member further has a tumbler mounting flange extends inwardly from one end of said stationary member opposite to said first mounting end, said tumbler mounting flange being formed with a tumbler hole that extends transverse to said axis and that has an inner hole end adjacent to said movable member, and an outer hole end opposite to said inner hole end, said tumbler being mounted in said tumbler hole and projecting through said inner hole end, said stationary member further having a tumbler cap for closing said outer hole end of said tumbler hole.

2. The sink stopper as claimed in claim 1, wherein said perforated strainer wall of said strainer has an outer peripheral edge, said strainer further having a peripheral wall that extends from said outer peripheral edge of said perforated strainer wall around said axis and that has a distal edge, and a peripheral flange that extends radially and outwardly from said distal edge of said peripheral wall, said strainer being adapted to be mounted on the base such that said peripheral wall extends into the drain hole to dispose said perforated strainer wall in the drain hole and such that said peripheral flange is seated on the base.

3. The sink stopper as claimed in claim 2, further comprising a rubber gasket sleeved on said peripheral wall Of said strainer and adapted to abut sealingly against the hole-confining wall when said strainer is mounted on the base.

4. The sink stopper as claimed in claim 1, wherein said axis extends in a vertical direction, said first control point being disposed below said second control point, said guide groove further having a first section ascending from said first control point and having an upper end disposed at a level above said second control point, a second section descending from said upper end of said first section and extending to said second control point, a third section ascending from said second control point and having an upper end disposed at a level above said second control point, and a fourth section descending from said upper end of said third section and extending to said first control point, wherein application of a first pressing force on said closure member against biasing action of said biasing member while said tumbler engages said guide groove at said first control point retracts said movable member into said stationary member and causes said tumbler to move along said first section until said tumbler is disposed at said upper end of said first section, and subsequent removal of the first pressing force enables said movable member to extend out of said stationary member by virtue of the biasing action of said biasing member and causes said tumbler to move along said second section until said tumbler engages said second control point, thereby retaining said movable member at the second position; and wherein application of a second pressing force on said closure member against the biasing action of said biasing member while said tumbler engages said guide groove at said second control point retracts said movable member into said stationary member and causes said tumbler to move along said third section until said tumbler is disposed at said upper end of said third section, and subsequent removal of the second pressing force enables said movable member to extend out of said stationary member by virtue of the biasing action of said biasing member and causes said tumbler to move along said fourth section until said tumbler engages said first control point, thereby retaining said movable member at the first position.

5. The sink stopper as claimed in claim 1, wherein said movable member further has a stop flange that extends from one end of said movable member opposite to said second mounting end, said stop flange being disposed in said stationary member and abutting against said tumbler mounting flange to prevent removal of said movable member from said stationary member.

6. The sink stopper as claimed in claim 5, wherein said biasing member is disposed in said stationary member and biases said stop flange toward said tumbler mounting flange.

7. The sink stopper as claimed in claim 1, wherein said closure member includes a press cap mounted on said second mounting end of said movable member, and a seal ring having an inner peripheral portion that is connected to said press cap and a skirt portion that extends in radial outward directions from said inner peripheral portion, said skirt portion being configured to form the clearance with the base when said movable member is at the first position and being adapted to abut sealingly against the base to seal the drain hole when said movable member is at the second position.

8. The sink stopper as claimed in claim 7, wherein said press cap has one side formed with a coupling sleeve, said coupling sleeve having a distal end, said closure member further including a fixing ring fitted into said coupling sleeve, said fixing ring having a distal end formed with a radial outward end flange, said inner peripheral portion of said seal ring being clamped between said distal end of said coupling sleeve and said end flange on said fixing ring.

* * * * *